United States Patent [19]

Hollenberg

[11] Patent Number: 4,850,509

[45] Date of Patent: Jul. 25, 1989

[54] QUICKLY ERECTABLE CONTAINERS

[76] Inventor: Dennis D. Hollenberg, 231 SW. 176th St., c/o Doughman, Seattle, Wash. 98166

[21] Appl. No.: 25,816

[22] Filed: Mar. 13, 1987

[51] Int. Cl.[4] ..... B65D 90/04

[52] U.S. Cl. ..... 220/462; 383/120; 220/410

[58] Field of Search ..... 220/462, 410, 463, 465, 220/468, 72, 85 B; 229/41 R, 41 B, 101, DIG. 3; 383/104, 112, 120, 123, 121; 141/108; 150/52 E

[56] References Cited

U.S. PATENT DOCUMENTS

| | | | |
|---|---|---|---|
| 1,623,107 | 4/1927 | Goodykoontz | 383/121 |
| 1,691,906 | 11/1928 | Lefkowitz | 383/120 |
| 2,361,876 | 10/1944 | Schell | 220/463 |
| 3,295,643 | 1/1967 | Peterson et al. | 383/120 |
| 3,399,818 | 9/1968 | Stegner | 220/462 |
| 3,559,847 | 2/1971 | Goodrich | 220/410 |

*Primary Examiner*—Willis Little

[57] ABSTRACT

Containers which can be quickly erected comprising a pair of main panels (44 and 45) connected by a joining tension means (56) and an articulated stretcher means (48, 49, and 50) for pushing apart said pair of main panels in opposition to said tension means, said stretcher panel is stable in only two configurations, namely collapsed or erected. Inexpensive, quickly erectable containers for different uses which incorporate similar structural elements can be produced and include trash containers, scoop-front receptacles, shrub and plant pots, shelters for eqipment and organisms, fluid containers, and open-top containers for the collection and portioning of bulk foods.

20 Claims, 7 Drawing Sheets

24
32
36
26
27
34
33
25
37
1 →
28
29
31
38
30
35

24
29
36
28
26
25
1 →
31
35

44
52
56
47
54
46
48
49
53
45
2 →
57
51
58
50

44
49
56
48
46
53
45
2 →
51

QUICKLY ERECTABLE CONTAINERS

BACKGROUND OF THE INVENTION

The subject invention relates to containers and more specifically to inexpensive containers in a large range of sizes and functions having panels with fold lines which enable the containers to be quickly erected from a flat, collapsed state to an erect, stably upright and fillable one without the use of additional materials or implements. Containers of this invention range in size from less than a pint capacity through fifty-gallon receptacles to portable enclosed shelters for humans, animals or equipment storage.

PRIOR ART

Heretofore, the types of inexpensive containers available have been limited to collapsible bags, non-collapsible bottles, and cartons which require the application of additional materials such as adhesive tape to secure the carton's bottom seam. Most prior art devices to aid in filling platic trash bags consists of auxiliary structural devices which function by supporting the bag in a serviceable state until filled and then are removed from the bag. Such devices include holders for trash bags such as U.S. Pat. Nos. 3,936,037 (Alexander), 4,379,519 (Sherwood), and 4,537,376 (Buku). The latter two inventions do not provide means for protecting the bag from puncture and tearing by objects contained in them and, in all three inventions, the plastic trash bag must first be opened, fitted to the holder, and, finally, the holder must then be removed, an additional operation which incurs inconvenience and spillage and contamination of the holder by the contained mateiral.

Prior art collapsible containers which employ integral erecting means, such as the quickly erected scoop-type cartons, including U.S. Pat. Nos. 3,630,430 (Strubel), 3,864,157 (Mendez), 4,185,764 (Cote), and 4,267,955 (Strubel), all comprise upward acting, "snap-up," bottoms. Such containers with upwardly acting bottoms are not suitable for containing dense materials, especially those which are highly liquid, because they tend to collapse during filling. The reason for their collapse is that the weight of the contained material, opposing the upwardly acting container bottom during erection of the container, forces the bottom in the downward, collapsing direction. Thus, the utility of such containers is limited.

Other collapsible containers include U.S. Pat. Nos. 3,845,897 (Buttery), 3,877,632 (Steel), and 3,971,503 (Allan), the prior two of which employ inwardly acting side panels which act against the weight of the contained material, as do the aforementioned, and constrict the container volume as well. Additionally, the base of such containers, consisting of basal side panel extensions which act like two small feet, provides limited upright stability for the erected containers.

Beverage packaging is currently evolving towards collapsible metallized plastic bags which, in the instance of wine packaging, for example, require a rigid carton to provide rectilinear shape, upright stability, stacking strength, protection from puncture, and an easily decoratable surface.

APPLICATIONS TO CONSUMER PRODUCT FIELD

In the consumer product field there is a need for inexpensive, quickly erectable, semirigid containers, meaning rigid containers whose panels can be deformably curved in one dimension in the course of their erection, which provide improve upright stability, an integrally printable surface, comparatively high product protection, a geometry which is inherently strong both internally and externally for containing materials which may be pressurized and for stacking the filled containers, respectively, and unique, visually appealing shapes. Such characteristics are particularly important in the case of liquids packaging in which any new, less costly container type must be visually similar to familiar bottle shapes in order to readily gain consumer acceptance. Containers of subject invention include types with internal bladders for holding and delivering fluid materials stored under pressure without degenerating the quality of the contained product through the loss of constituents or contamination with other material. Empty, such containers could be transported and stored in a collapsed state and erected at the filling site. Additionally, in the case of aerospace and recreational applications, emptied containers can be optionally and easily recollapsed to minimize the stored containers's volume; fabricated in appropriately durable materials, such containers can be reused.

APPLICATIONS TO THE REFUSE COLLECTION FIELD

That there is a long-recognized need for inexpensive, easily and quickly erected, stable containers to enable the rapid collection of grass clippings, fallen leaves, litter, process byproducts, and such, facilitated by a built-in scoop and handle, is substantiated by the large number of U.S. utility patents issued for such devices including support structures for the ubiquitous plastic trash bag. The subject invention provides simple solutions for these recognized problems and a related embodiment is a substantially meshed quickly erected, disposable container for the collection of grass clippings or leaves blown from a mower or leaf blower, respectively. A container of subject invention has inherent means for quickly erection and therefore saves time and effort compared to bag holders such as those mentioned above and eliminates the time-consuming opening and mounting of a separate garbage bag to a bag-holding frame and the subsequent awkward removal and storage of the soiled frame after the bag has been filled. Additionally, the general use of trash containers of this invention in a municipal waste disposal system enables a more efficient refuse collection method which uses substantially automated equipment for pick up and transfer to a processing facility. Such a container is particularly suited to refuse-fueled bulk reduction and electricity generating plants because the heat energy content of the trash feedstock is dependably increased by the combustible materials (paper and plastics) from which the inexpensive disposable container of subject invention is fabricated.

THE HAZARDOUS WASTE FIELD

Collection and disposal of hazardous materials requires inexpensive quickly-erectable containers which provide the positive isolation of radioactive, chemical and biological materials afforded by plastic bags yet which include an inherent means of protecting or armoring the plastic bags from puncture by the objects contained in them. Inexpensive containers of subject invention when filled can be incinerated or put into a permanent disposal means in the cases of biological and radioactive materials, respectively, thus obviating the danger of spreading contamination which is inherent in the use of some non-collapsible waste receptacles which are reused.

THE EMERGENCY SERVICES FIELD

A need exists for easily erectable, inexpensive, and durable emergency housing structures for displaced victims of earthquake, war, fire, etc. The subject invention provides for quickly erected, substantial structures for use as emergency housing which, relative to fabric structures, are inexpensive and durable. Additionally, a need exists for quickly erectable sandbags which can stand upright unaided prior to filling and can therefore be filled by one person unaided by mechanical bag holders or supports not readily availabe at the site of the emergency. Such a self-standing sandbag thereby frees the second person, the one normally required to hold open the mouth of the bag, to also fill bags; the production of filled sandbags during the flooding emergency is doubled thereby.

The plurality of needs clearly existing in all of the aforementioned fields are fulfilled by kinds of containers to which this invention is directed and which have a characteristic configuration of fold lines on semirigid and flexible structural elements which allows the flat-folded containers to be quickly erected. Further, such containers are inherently strong; they can withstand large internal and external loading forces compared to other containers of similar cost due to the resulting combination of intersecting planar and curved panels. Certain of the containers of this invention provide an outwardly curved bottom panel which cradles the forces of the container's burden in the same outward (relatively downward) direction as the movement taken by the bottom panels in the course of the container's erection and which thereby increases the internal pressure capacity and load capacity of the containers. For example, in contrast to the upwardly erected bottom panels of the aforementioned scoop-type prior art, the bottom panels of the containers of this invention are erected downwardly which is the same direction of the force or weight of the contained materials. The resulting geometry provides containers of subject invention with inherently greater weight capacity in relation to the effective strength of the container material than do current container types. Curved similarly to the bottom panels are the outwardly curving main panels of certain embodiments of this invention. Outwardly curving panels are inherently more resistant to distortion, distortion being caused by a force being applied to one side of the panel which in this case is the interior side of the container, than are flat panels. Flat panels distort more readily than do appropriately curved panels because the distorting force, a vector, must be opposed by an equal force in order that the panel not distort. Flat, semirigid panels can provide no such opposing force until said flat panels actually distort, a distortion which, effectively, provides stabilizing opposing force by resolving the force vector which is normal to the panel plane into a pair of opposing vectors coincident with the curved panel's plane. Subject invention solves this load distortion problem by providing a container having multiple outwardly curved panels.

Containers of this invention also provide a means for delivering the contents of a sealed, frangible packet immediately prior to the container's use. Specifically, as the container is erected, the movement of the erecting means, for example, a lanyard or the movement of the bottom panel segments provides a mechanism for breaking said frangible packet which may contain any of a number of materials including genetically engineered organisms which reduce the container materials or its contents, olfactory substances including repellents to discourage pilfering by animals of containers of subject invention as garbage receptacles, and odor neutralizing or masking substances.

Further, certain of the erected containers of this invention include bottoms supported by paired vertical surfaces or webs which are composed of basal portions of the container walls and a second, inner panel, a resulting combination which thereby produces a recessed bottom enabling the containers to stand stably upright on irregular surfaces, a feature which also facilitates filling. Additionally, in certain containers, ancillary devices including delivery valves and hoses may be stored within the recessed area prior to use. The quickly erected containers of this invention are fabricated of inexpensive materials including paper, boxboard, plastics, metal foils and combinations thereof.

SUMMARY OF THE INVENTION

Accordingly, several objects and advantages of subject invention include providing large containers for the collection of trash and lawn debris which are very quickly erectable from a collapsed state, stand stably upright on uneven surfaces, are inexpensive to manufacture, certain of which are disposable, provide protection to the container walls from puncture by the contained materials, provide built-in scoops and handles for aiding debris collection, are easily closable, and serviceably require no additional holders or stands. Other objects of my invention are to provide shrubbery planters, fruit and vegetable harvesting containers, and bulk food portioning and packaging which are easily erectable from a collapsed state. Additional objects of my invention are to provide high-strength, durable but inexpensive collapsible structures for equipment and organisms, including humans under emergency conditions. Lastly, objects of my invention are also to provide quickly erectable, very inexpensive, easily printable, attractively shaped, stably standing, strong containers for fluids, some of which may be pressurized liquids. In erecting these containers applications of additional materials such as adhesives, etc., or further operations are not required.

DESCRIPTION OF THE INVENTION

Referring now to FIGS. 1 through 4, the two primary structural element types of which this family of quickly erectable containers is comprised are generally designated by 1 and 2.

Figure 1:
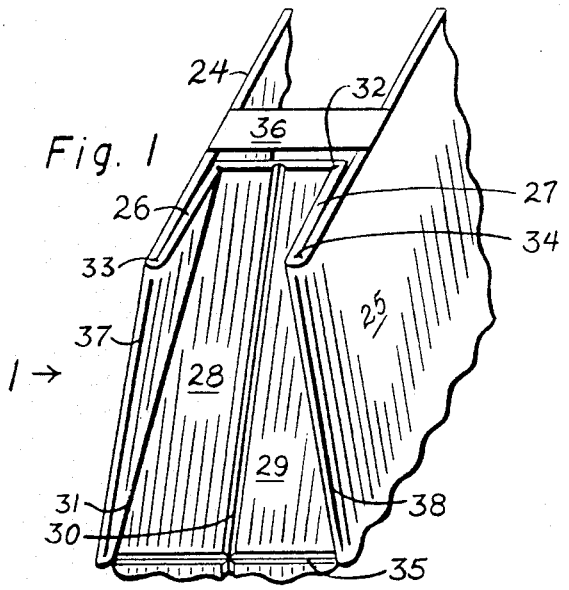
FIG. 1 is an isometric view of a part of an erected container utilizing straight-sided polygonal panel segments.
Figure 2:
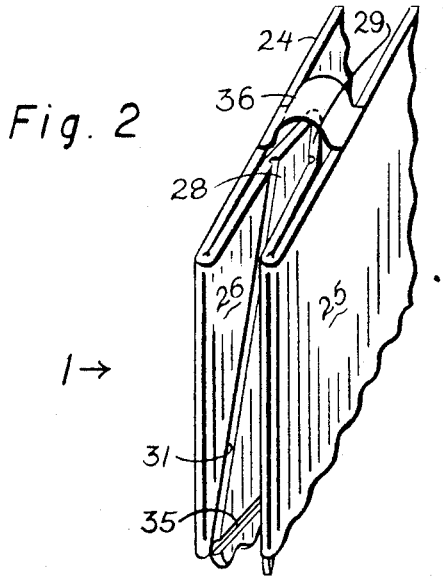
FIG. 2 is the same part of FIG. 3 in its partially collapsed state.

FIGS. 1 and 2 show Type 1 structural in its erected and partially collapsed states, respectively, in which stretcher panel segments 28 and 29 are mutually connected by hinge 30, at the basal end of said hinge said segments are connected to hinge 35 which is further connected to other panels, and on opposite sides, said segments are severally hingedly connected to return panels 26 and 27 by hinges 31 and 32, respectively, and which, in turn, are severally hingedly connected to main panels 24 and 25, respectively. Said main panels are apically connected to side panel 36 and their front edges form salients 37 and 38. During erection, main panels 24 and 25 are forced apart by paired polygonal stretcher panel segments 28 and 29 which are joined along the common edge of each by hinge 30 and respectively connected along their opposite, outer-most edges through hinges 31 and 32, which diverge relative to one another proceeding in the direction of dihedral hinge 35 and terminate thereon. Side panel 36, shown in relatively reduced size in the interest of clarity in the figures but in practice substantially connects adjacent contraposed edges of the main panels as is shown in the following figures, e.g. FIG. 5, functions as a tension component against which the compression components, consisting of polygonal stretcher panel segments 28 and 29 and common hinge 30, act to maintain the Type 1 structural element's shape when erected. Dihedral hinge 35 terminates the plane of the paired polygonal stretcher panels such that a different planar surface can be formed relatively adjacently downward as suggested in FIGS. 1 and 2. Further, salients 37 and 38, formed by the flat sheet material of the container blank having been folded on hinges 33 and 34, respectively, during fabrication, provide the resulting containers with increased structural capacity and upright stability. During fabrication the faces common to return panels 26 and 37 and to main panels 24 and 25 are mechanically fastened or bonded to one another, respectively.

Figure 3:
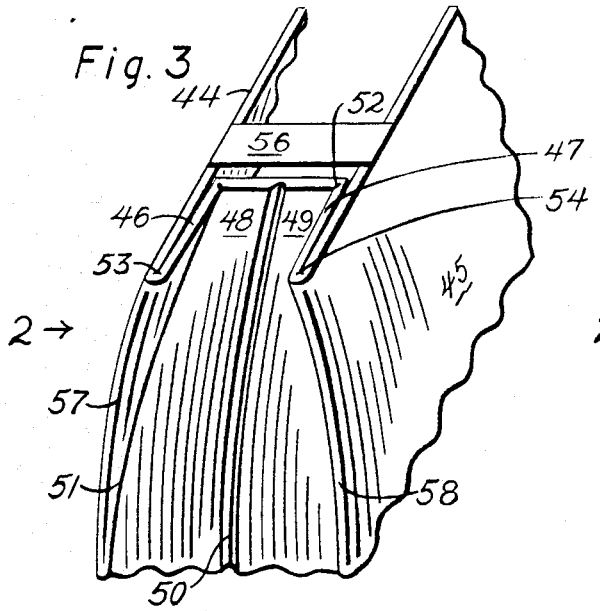
FIG. 3 is an isometric view of a part of an erected container utilizing paired arcuate-sided polygonal panel segments.
Figure 4:
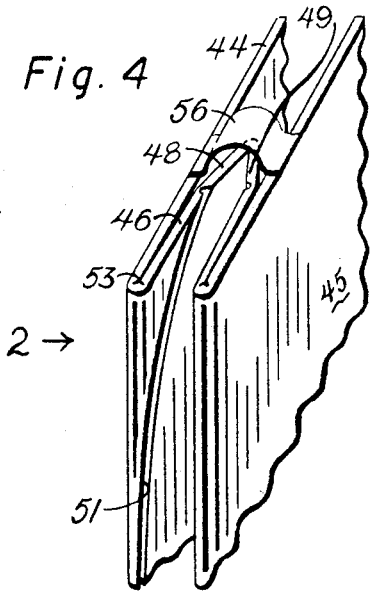
FIG. 4 is the same part of FIG. 5 in its partially collapsed state.

FIGS. 3 and 4 show Type 2 structural element, which is generally an improvement upon Type 1, in its erected and partially collapsed states, respectively, in which main panels 44 and 45 are held apart by paired arcuate stretcher panel segments 48 and 49 which are joined along their centrally common edges by hinge 50 and are severally connected along opposite edges by arcuate hinges 51 and 52 to complementarily arcuately edged return panels 46 and 47 which, in turn, are jointed oppositely to main panels 44 and 45 by hinges 53 and 54, respectively. During fabrication the faces of return panels 46 and 47 which are adjacent to those of main panels 44 and 45, respectively, are mechanically fastened or bonded to one another. Side panel 56, illustrated in much reduced size in the interest of clarity in the drawing and in practice substantially connects the edges of the main panels as is shown in the following figures, provides the tension component against which the compression components, consisting of arcuate stretcher panel segments 48 and 49 and common hinge 50, coact to maintain the Type 2 structural element's shape when erected. Further, salients 57 and 58 are formed by the flat sheet material of said container blank having been folded on hinges 53 and 54, respectively, during fabrication and provide the resulting containers with increased structural capacity.

In the collapsed state, the structural type's stretcher panel segments 48 and 49 are mutually substantially contraposed in the first of two stable configurations. When the container is in the erected state, said convex panel surfaces, including main panels 44 and 45, arcuate stretcher panel segments 48 and 49, and return panels 46 and 47, are stably disposed, in the second configuration, due to the coactive effect of arcuate hinges 51 and 52 and the normally substantially flat, arcuate stretcher panel segments 48 and 49.

Arcuate stretcher panel segments 48 and 49, while having continuous arcuate hinges where said segments are distally connected to their respectively adjacent return panels, can be viewed heuristically as having a range of incremental lengths of stretcher arm components which extend perpendicularly outward from the common axis of hinge 50 and, in such a view, the relative lengths of said arms can be seen to increase from one arm to the next most medial arm along said hinge.

Oppositely to said hinge, these arms are severally hingedly connected on their distal ends to return panels 46 and 47 by hinges 51 and 52. When the containers is erected by moving said stretcher panel hinge 50 downward, the heuristically viewed increasing range of stretcher arm lengths produces an incrementally offset relation between each successive stretcher arm component. This offset relation causes the stretcher panel to assume the second of the two possible stable configurations in which the panel segments, and their arcuate articulation to the return panels, mutually act to form an outwardly convex stretcher panel surface. While such a heuristic view ignores the actual continuous nature of the arcuate hinge connection between each stretcher segment and its adjacent return panel, a physical arrangement of such incremental ribs or compression elements, as few as three on each side of the common stretcher panel hinge line, can serve the same purpose of stretching the pair of main panels apart. Furthermore, with the addition of flexible sheet or other means to provide a continuous surface between said elements, a container bottom means can similarly be effectuated.

Figure 5:
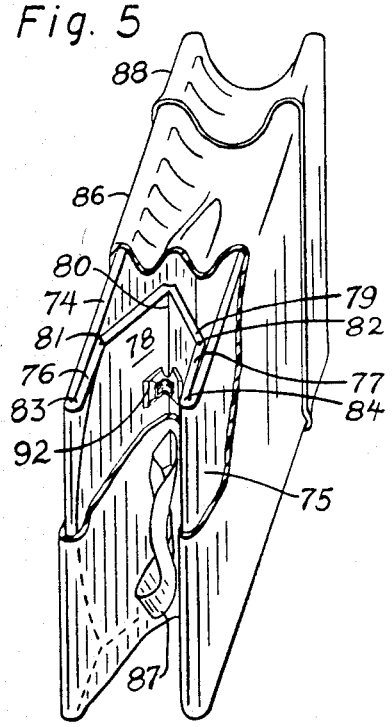
FIG. 5 is an isometric view of the underside of a quickly erected container of the kind used as a trash receptacle in its partially collapsed state.
Figure 6:
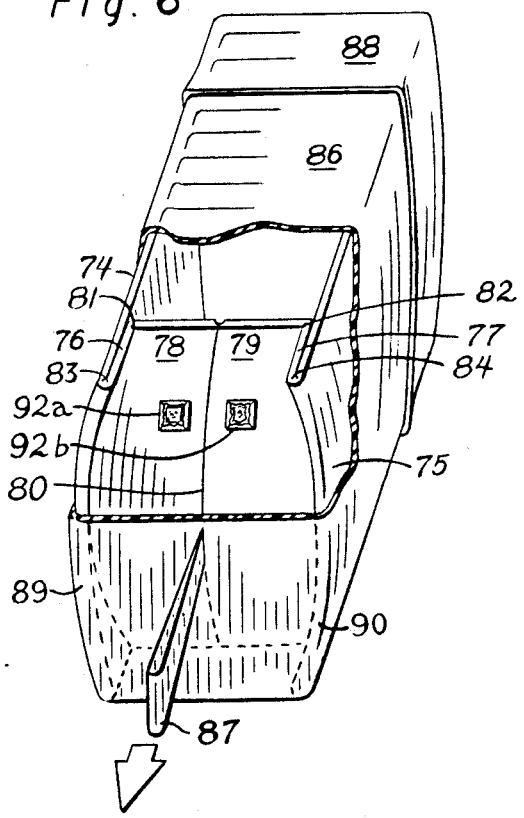
FIG. 6 is an isometric view of the underside of the same container in FIG. 7 in its fully erected state.

FIGS. 5 and 6 are isometric views of the underside of an open-top container in partialy collapsed and fully erected states, respectively, which includes Type 2 structural elements including main panels 74 and 75 which, when the container is erected, are held apart by coacting arcute stretcher panel segments 78 and 79 which are joined along their centrally common edges by hinge 80 and severally joined along their opposite, outer-most arcuate edges by arcuate hinges 81 and 82 to return panels 76 and 77 which are, in turn, joined along opposite edges by hinges 83 and 84 to main panels 74 and 75, respectively.

Said coacting arcuate stretcher panel segments 78 and 79, when means including lanyard 87 are used to erect the container, rotate relatively oppositely about common axis means hinge 80 from a collapsed configuration as in FIG. 5, in which the surfaces of said stretcher panel segments 78 and 79 are substantially vertically parallel and contraposed, to a second erected configuration in which said stretcher panel segments are extended substantially and stably opposite one another such that the pair of segments form a continuous surface which appears in FIG. 6 as a convex surface and causing thereby main panels 74 and 75 to outwardly appear similarly convex. Upon erecting the container, force is applied by means including compression along the opposite longitudinal edges of main panels 74 and 75 or, alternatively, as tension force applied by the operator in a direction outward from the container on paired stretcher panel segments 78 and 79 by means including the lanyard 87 shown in FIG. 6 or in combination with any other method. Opposite ends of frangible packet 92 are connected to each of said coating arcuate stretcher panel segments such that, upon erection of the container and subsequent movement of said segments, said packet breaks into parts 92*a* and 92*b* and releases its enclosed substances into the basal portion of the container thereby. Flexible bag 86 provides the side panel tension component against which the compression components, including coacting arcuate stretcher panel segments 78 and 79 and hinge 80, act to maintain the container's shape, using Type 2 structural elements, when erected. Further, salients 89 and 90 are formed by the container's flat sheet material having been folded on hinges 83 and 84 during fabrication which provides the erected container with a strong, recessed base and superior stability on uneven surfaces. Additionally, after the container is filled, flexible envelope skirt 88 can be raised upwardly above the mouth of said container and secured by means to close off the open end of said envelope.

Figure 7:
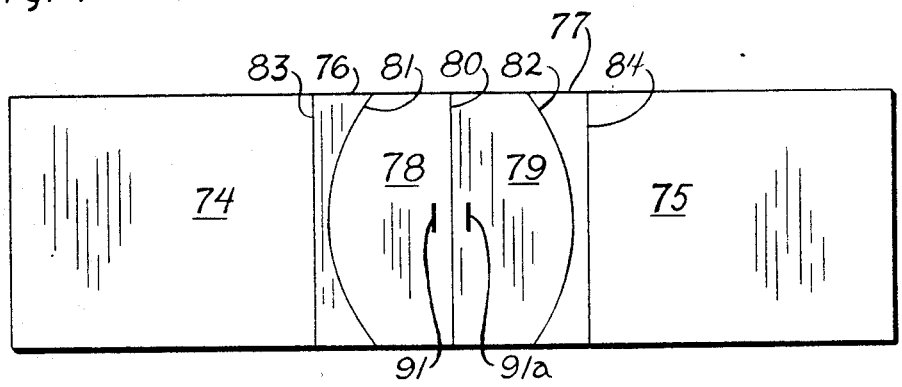
FIG. 7 is a plan view of the blank, the side which will be interior, which forms the semirigid part of FIG. 7.

FIG. 7 is an isometric view of the interior side of the integral blank from which the container's semirigid elements are produced and includes main panels 74 and 75 which are severally connected by hinges 83 and 84 to return panels 76 and 77 and said return panels are connected by arcuate hinges 81 and 82 to arcuate stretcher panel segments 78 and 79, which said panel segments slot means for attaching lanyard 87 and are mutually connected by hinge 80. The blank in FIG. 7 is fabricated by, first, folding main panel 75 on hinge 84 in a direction relatively leftward, meaning that the direction of the movement is initially towards the viewer and thence in a lefthanded direction, and mechanically fastening or bonding the face of return panel 77 to the basal portion of said main panel and, second, folding the group of panels consisting of arcuate stretcher panel segment 79, return panel 77, and main panel 75 in a direction relatively rightward on hinge 80 and, third, folding main panel 74 in a direction relatively rightward on hinge 83 and mechanically fastening or bonding the face of return panel 76 to the basal portion of said main panel. Fabrication of the container proceeds with the inclusion of the lanyard and flexible envelope in appropriate order.

Figure 8:
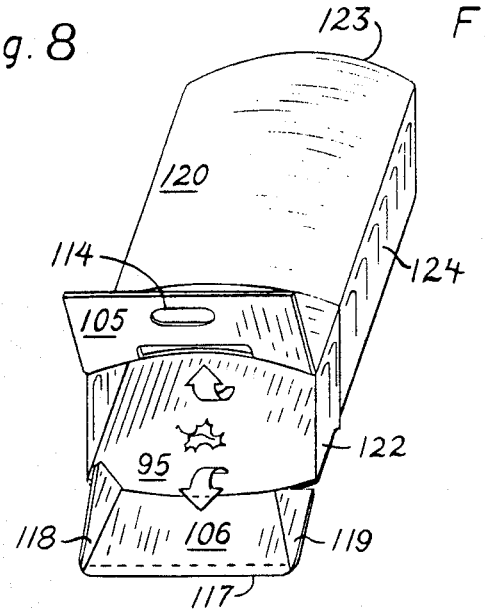
FIG. 8 is an isometric frontal view of an erected leaf and trash receptacle in horizontal position for debris collecting.
Figure 9:
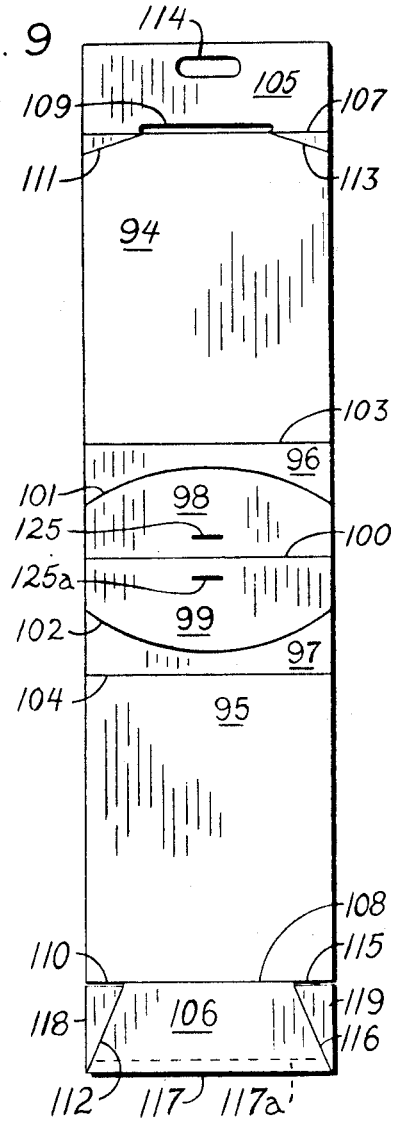
FIG. 9 is a plan view of the blank, the side which will be interior, for the semirigid component of the leaf and trash receptacle of FIG. 10.

FIG. 8 is an isometric view of a quickly-erected container including Type 2 elements and a self-contained handle 114 and scoop 106. FIG. 9 shows the semirigid blank from which the semirigid component is fabricated. Referring now to FIG. 8 in which can be seen through the container opening main panel 95 hingedly attached to scoop flap 106, including feathered free edge 117, and said flap is laterally hingedly connected to sideboards 118 and 119; apically in the figure can be seen flap 105 including handle 114 and adjacently surrounding said opening is flexible envelope 120 including attached skirt 122 and optionally vented side panel 124 and integral bottom 123.

Said container in FIG. 8 is shown in its optional horizontal position for directly receiving debris including fallen leaves, grass and plant cuttings, trash and litter, etc., in which both the optionally unfolded self-contained scoope 106 and handle flap 105 are shown unfolded from their folded or stored position within the container to a position of use. As a scoop-front receptacle, the container is positioned by the operating person who manipulates the container by holding handle 144 and simultaneously sweeping said debris into the mouth of the container by using scoop 106 including a feathered free edge 117 and erectable side boards 118 and 119 into the container including main panel 95. Said container, including flexible envelope 120 and side panels 124, which optionally have means for venting air from the container through said envelope, and extensible skirt 122, the opposing sides of which may be joined by closure means to seal the top of said container. Formed when the container is erected, integral bottom 123 provides upright stability on flat and irregular surfaces.

Figure 10:
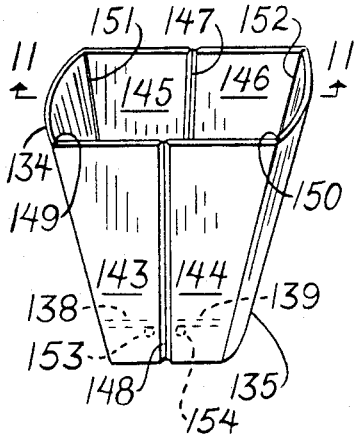
FIG. 10 is an isometric view of a substantially molded container in its erected state.

Referring now to FIG. 9 which is a plan view of the semirigid blank from which the structural parts of the container in FIG. 10 are fabricated, includes main panels 94 and 95 which are severally proximally connected to return panels 96 and 97 by hinges 103 and 104, respectively. Said return panels are severally connected to coacting arcuate stretcher panel segments 98 and 99 by arcuate hinges 101 and 102, respectively, and said panel segments, including severally erection lanyard attachment means 125 and 125*a*, are mutually connected by stretcher panel hinge 100. The distal portions of said blank include handle flap 105 and scoop flap 106 which are severally connected to main panels 94 and 95, by hinges 107 and 108, respectively, the former said main panel 94 including ancillary flap hinging means 111 and 113. Said handle flap 105 includes hinge clearance means 109 and handle means 114 and said scoop flap 106 includes scoop sideboards 118 and 119 which are severally connected by hinges 112 and 116, which said sideboards are separated from said scoop flap by clearance means 110 and 115, respectively, and feather edge 117 and feather edge terminus 117*a* are included in said scoop panel.

The container in FIG. 8 is fabricated from the blank in FIG. 9 by, referring to the latter figure, first, attaching the lanyard erecting means to attachment means 125 and 125*a*, second, folding the pair of panels 94 and 105 as a unit in a relatively downward direction on hinge 103 and mechanically fastening or bonding the face of return panel 96 to the adjacent portion of the face of said main panel and, third, folding the group of panels consisting of panels 94, 96, 98, and 105 as a unit in a relatively upward direction and, fourth, folding panels 105 and 106 severally in downward and upward directions and, fifth, folding the pair of panels 95 and 106 as a unit in a relatively upward direction on hinge 104 and mechanically fastening or bonding the face of return panel 97 to the adjacent portion of the face of main panel 95, sixth, the flexible envelope means 120 is substantially fixed about the fabricated blank and erecting means.

The container in FIG. 8 is erected in a manner similar to erecting that of FIGS. 6 and 7 and optionally unfolding flap 105, to provide access to handle means 114 and scoop flap 106, which includes feathered edge 117 to provide a ramped scoop to facilitate loading material into the container mouth, and side boards 118 and 119 which are hingedly attached to scoop flap 106 and may be optionally uprightly positioned to further facilitate said loading of material. Use of the container includes the operator holding, by one hand, handle means 114 and moving materials such as scattered debris upwardly along scoop flap 106 through the relatively elevated mouth of said container and into the relatively lower, unoccupied recesses of said container with a sweeping motion of an implement, including a broom or a rake, held in the operator's second hand and said operator then moving freely and continually to collect said debris with said container handily in tow. After said container is filled, unfolded flaps 105 and 106 may be refolded to cover the container mouth and flexible envelope skirt 122 may be drawn upwardly and secured for disposal or collection. Note that said flaps of the container in FIG. 8 may remain unfolded and the container may be positioned with its mouth upward and used as a trash receptacle.

Figure 11:
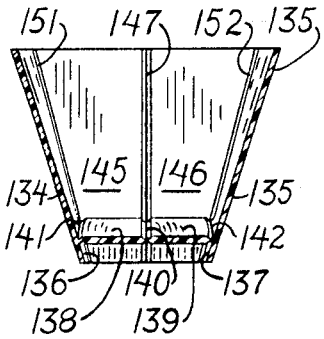
FIG. 11 is a vertical cross-section of the container in FIG. 12.

FIG. 10 and FIG. 11 depict an isometric view and a cross sectional view, respectively, of a quickly erectable recessed-bottom container in its erected state, suitable for use as a flower or shrubbery tub, including a Type 2 structural element which is fabricated by a molding method in which return panels 136 and 137 and arcuate hinges 141 and 142 are formed substantially integrally with main panels 134 and 135 and in which said method the return/main panel hinges having been obviated. Referring now to FIG. 10, main panel 134 is hingedly connected at opposite front and back edges to side panels 143 and 145 by hinges 149 and 151, respectively, and, continuing around the periphery of said container, said side panels are oppositely severally hingedly connected to complementary side panel segments 144 and 146 by hinges 147 and 148; said complementary side panels are further hingedly connected to the front and back edges of main panel 135 by hinges 150 and 152, respectively. Bottom panel means stretcher panel segments medial free-edge support means lug 153 and complementary lug receptacle means 154 are located on the inside face of side panels 143 and 144, respectively, and therefrom said lug means protrudes inwardly relative to said side panels and is, in the erected state, apically substantially contiguous to the underside of arcuate stretcher panels 138 and 139 in order to provide additional support to the free edge of said bottom panel means thereby. In the collapsed state said lug means 153 fits loosely and wholy into lug receptacle means 154 in which state said side panels 143 and 144 have fully rotated against one another about common hinge 148 and said collapsed container is flat.

Cross-sectional arrows 11 refer to FIG. 11, a cross-sectional view, shown in diagonal hatching, of the container in FIG. 10 which shows return panels 136 and 137 as basal interior parts of main panels 134 and 135, respectively, and distinguished from said respective main panels by arcuate hinges 141 and 142 which are oppositely hingedly connected to coacting arcuate stretcher panel segments 138 and 139, respectively, and said panel segments are mutually connected by hinge 140. FIG. 11 further depicts side panels 145 and 146, connected by side panel hinge 147, connected to main panels 134 and 135 by hinges 151 and 152, respectively.

Figure 12:
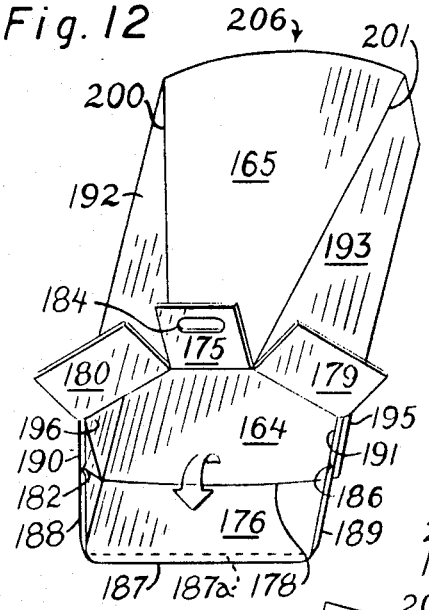
FIG. 12 is an isometric view of an erected debris collecting container which is in a horizontal position for collecting debris.

FIG. 12 is an isometric view of a quickly erected, scoop-handle container, including Type 2 structural elements and a pair of asymmetric side panels, which is fabricated substantially of semirigid material and comprises opposed main panels 164 and 165, the latter main panel being trapezoidal and hingedly connected to trapezoidal side panel segments 192 and 193 by hinges 200 and 201 and similarly hingedly connected to unfoldable flaps 175, 179, 180, said flaps can be unfolded from their stored position inside the cavity of said erected container, said flap 175 includes handle means 184. Main panel 164 is shown connected to unfoldable scoop flap 176 by hinge 178 which said scoop flap includes a leading free edge 187 which is substantially feathered and terminated by feather terminus 187a; scoop flap 176 is further attached to side panel segments 196 and 197 by left-hand gussets 188 and 190 and right-hand gussets 189 and 191 which gussets are mutually severally connected by hinges 182 and 186 to facilitate the optional unfolding of said scoop flap. Said container of FIG. 12 is shown in its horizontal position to facilitate sweeping or scooping filling material into the container cavity and when positioned vertically, said container stands stably and when positioned vertically, said container stands stably upon conterminous panel group 206 comprising the ends of panels 164, 165, 166, 167, 192, 193, 194 and 195.

Figure 13:
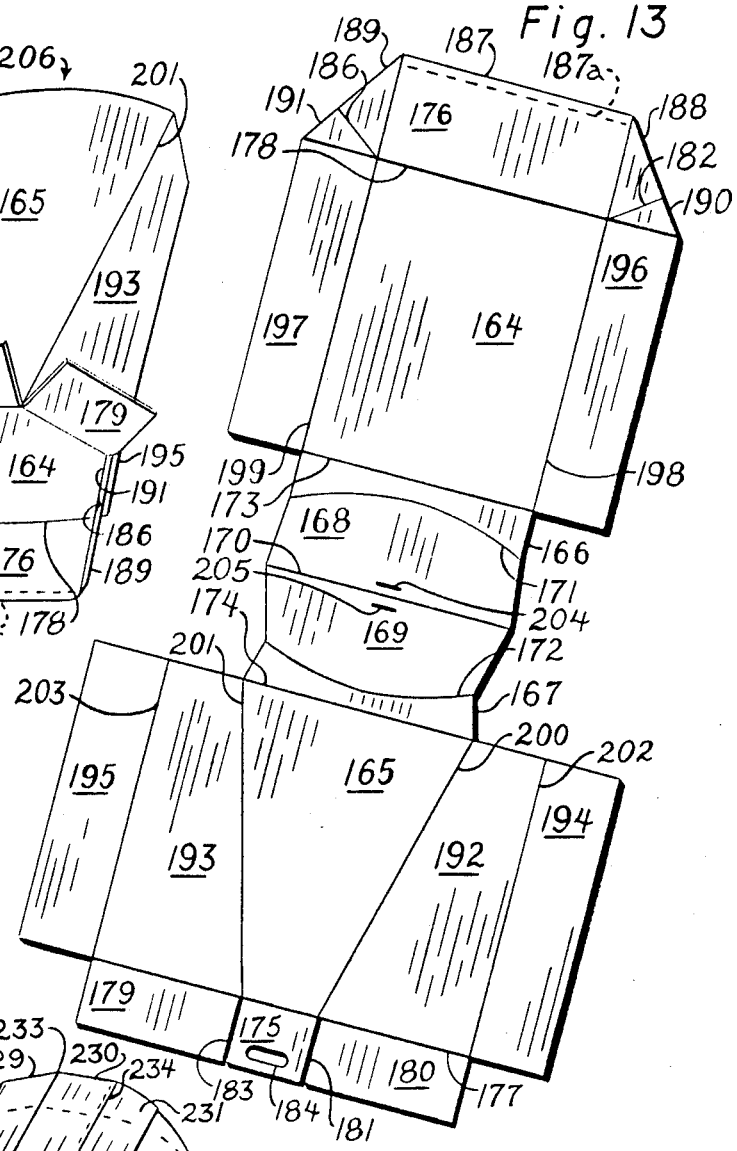
FIG. 13 is a plan view of the blank, the side which will be interior, from which the erected debris collecting container in FIG. 14 is formed.

FIG. 13 is a plan view of the semirigid blank, the side of which will be interior to the container, of flat material from which the erected, plan-asymmetric container in FIG. 12 is fabricated and includes main panels 164 and 165 which are severally proximally hingedly connected to return panels 166 and 167 by hinges 173 and connected to roof panel 230 by hinge 233 and said panel 230 is hingedly connected to roof panel overlap 231 by hinge 234; the inner face of said overlap 231 is connected to the outer face of main panel 214.

Figure 14:
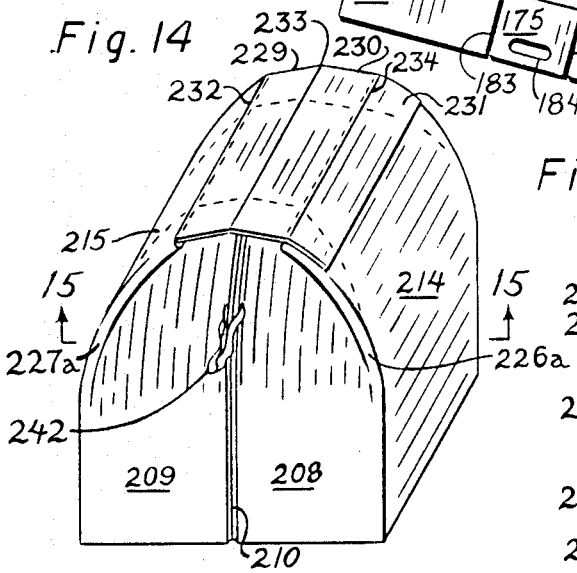
FIG. 14 is an isometric elevation view of an enclosed shelter for humans, animals or equipment.
Figure 15:
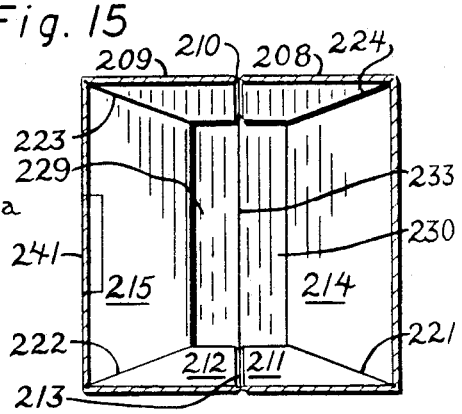
FIG. 15 is a lateral cross-section, upwardly viewed, of the enclosed shelter in FIG. 16.
Figure 16:
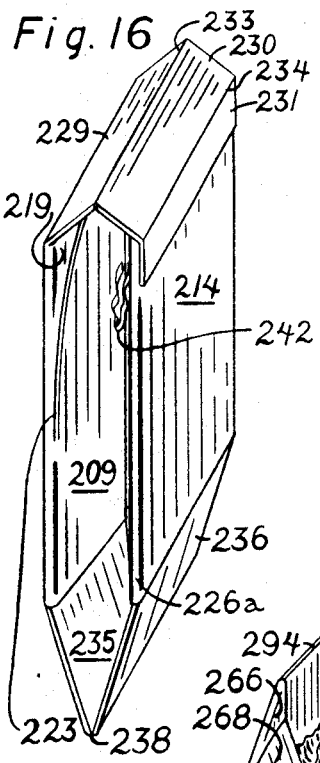
FIG. 16 is an isometric elevation view of the enclosed shelter of FIG. 16 in its partially collapsed state.
Figure 17:
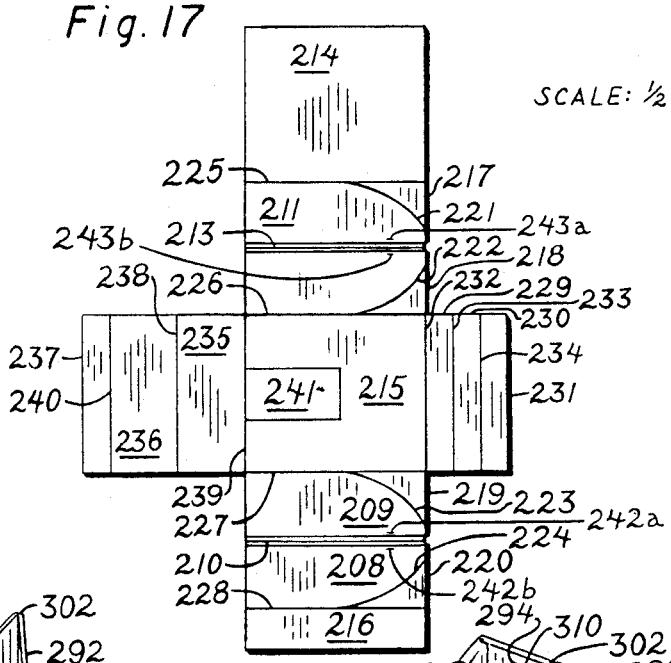
FIG. 17 is a plan view of the blank, the side which will be exterior and the scale of which is ½, from which the enclosed shelter in FIG. 16 is fabricated.

Referring now to FIG. 17 which is a plan view of the semirigid blank, drawn in one-half of the scale of the container in the views of FIGS. 14, 15, and 16, of which said container is fabricated and in which can be seen main panel 215, the right side of which is the container apex and the left side is the container base, in the figure, of which the basal portion of said panel is hingedly connected to arcuate stretcher panel segment 212 and the apical portion of said main panel is connected to return panel 218, on upper left and upper right edges, respectively, by hinge 226, said return panel is arcuately hingedly connected to the apical portion of said stretcher panel segment by arcuate hinge 222, and stretcher panel segment 212 is distally hingedly connected to coacting arcuate stretcher panel segment 211 by stretcher panel hinge 213, the apical portions of said stretcher panel segments 211 and 212 severally include erection lanyard attachment means 243*a* and 243*b*, disposed bilaterally to said hinge 213. The apical arcuate edge of said stretcher panel 211 is hingedly connected to return panel 217 by arcuate hinge 221 and both arcuate stretcher panel 211 and return panel 217 are hingedly connected to main panel 214 by hinge 225. Referring now to said main panel 215, which includes access means 241, the lower edge, in the figure, of said main panel apical portion is hingedly connected to return panel 219 and the basal portion of said main panel is connected to arcuate stretcher panel segment 209 by hinge 227 and said return panel is hingedly connected to the apical portion of said stretcher panel segment 209 by arcuate hinge 223, and said arcuate stretcher panel segment 209 is connected to coacting stretcher panel segment 208 by stretcher panel hinge 210, the apical areas of said panel segments 208 and 209 bilaterally to said hinge 210 include erecting lanyard attachment means 242*a* and 242*b*, and said panel segment 208 is relatively rightwardly connected to return panel 220 by arcuate hinge 224 and both said segment 208 and return panel 220 are connected to main panel underflap 216, basally and apically, respectively, by hinge 228. Referring now to the righthand side of main panel 215 which is apically hingedly connected to roof panel 229 by hinge 232 and said panel 229 is hingedly connected to roof panel 230 by hinge 233 and said panel 230 is hingedly connected to roof panel overflap 231 by hinge 234. Said main panel 215 is basally hingedly connected to floor panel 235 by hinge 239 and said panel 235 is hingedly connected to floor panel 236 by hinge 238 and said panel 236 is hingedly connected to underflap 237 by hinge 240.

Fabrication of the large dimension quickly erectable container of FIG. 14 from the blank shown in ½ scale in FIG. 17, the exposed side of which will be substantially interior to the fabricated container: first, the group of panels comprised of panels 208, 209, 216, 219, and 220 is folded as a unit relatively upward on hinge 227, which is relatively over panel 215, and then the face of return panel 219 is mechanically fastened or bonded to the matching portion of the face of main panel 215. Second, by folding the group comprised of panels 208, 216, and 220 as a unit relatively downward on hinge 210 and, third, underlap panel 216 is folded relatively upward on hinge 228, in the same direction as was the first fold. Fourth, in a similar but oppositely directed series of steps, the group of panels composed of 211, 212, 214, 217, and 218, is folded as a unit on hinge 226 in a relatively downward direction so that panel 215, et al., are covered and the face of return panel 218 is then mechanically fastened or bonded to the matching portion of the face of main panel 214 and, fifth, the group of panels composed of 211, 214, and 217 are folded relatively upward, oppositely to the previous folding operation, on hinge 213 and, sixth, the group of panels composed of panels 235, 236, and 237 is folded on hinge 238 relatively rightwardly such that underlap panel 237 overlays panel 215, et al., and seventh, panel 214 is folded relatively downwardly on hinge 225 such that said panel 214 covers all previously folded panels and the face of return panel 217 is mechanically fastened or bonded to the adjacent facial portion of main panel 214 and, concurrently, the face of floor underlap panel 237 is mechanically fastened or bonded to the mathcing face of main panel 214 and, concurrently, the face of underlap panel 216 is mechanically fastened or bonded to the matching face of main panel 214, eighth, the group of roof panels composed of panels 229, 230, and 231 are folded relatively from right to left on hinge 233 such that roof panel overlap 231 is mechanically fastened or bonded to the outer face of main panel 214.

Operation of large dimension quickly erectable container: the collapsed container as shown in FIG. 16 is erected by applying tension outward, relative to the container, on the erecting lanyards 242 and 243 the attachment points of which are shown in FIG. 17 or through such means as to move stretcher panel hinges 210 and 213 serially or concurrently substantially along the entire, relatively vertical, length of each of said hinges in a direction relatively outwardly from the container's interior, the effect of which is to rotate oppositely about said hinges each segment of each pair of coating stretcher panels coactively apart from an initially collapsed disposition, which is contraposed, to a second, stable position in which the paired edges of said segments located oppositely to said hinges lie mutually on a single unbroken and connected surface (in which, points located on opposite paired edges of said segments are substantially equidistant from the basal margin of said segments then such points fall substantially on opposite ends of a lateral, relatively horizontal, straight line). Further, during application of sufficient tension to said erecting lanyards or application of force thorugh other means, bottom panels 235 and 236 form a substantially planar surface or floor and roof panels 229 and 230 form a roof such that all of which aforementioned parts form a substantially enclosed container into which entry is gained through access means 241 and which may be sealed further from wind infiltration by mechanical fastening or bonding or other means to join floor end margins and lower margins of arcuate stretcher panels and likewise roof panel end margins and upper margins of said stretcher panels as needed. Further, said erected container may be substantially anchored using stakes or other means to secure the container in an upright, erected position when beset by winds. Inherently structural arch features 226*a* and 227*a* of said container are formed in the erection of the container by the stretching force of said stretcher panel segments on said return panels which have been fixed to the underside of the main panels 214 and 215 during fabrication. The intersection of said arch features and said main panels when arched gives the container an external load capacity which, in static tests, greatly exceeded that of rectilinear containers.

Figure 18:
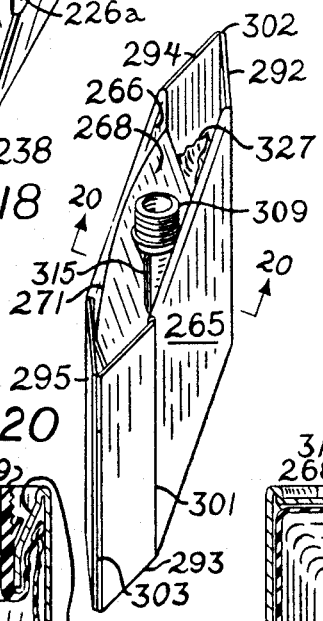
FIG. 18 is an isometric view of a shell and bladder container for fluids in its partially collapsed state.
Figure 19:
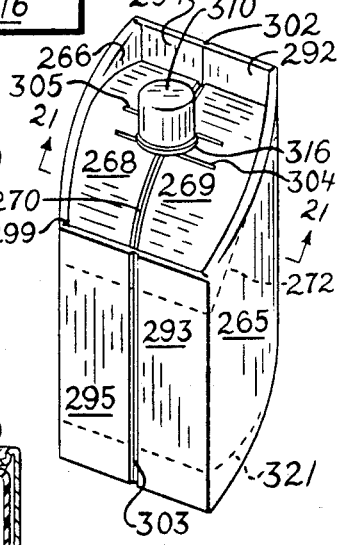
FIG. 19 is an isometric view of the shell and bladder container for fluids in FIG. 10 in its erected state, filled and capped.
Figure 20:
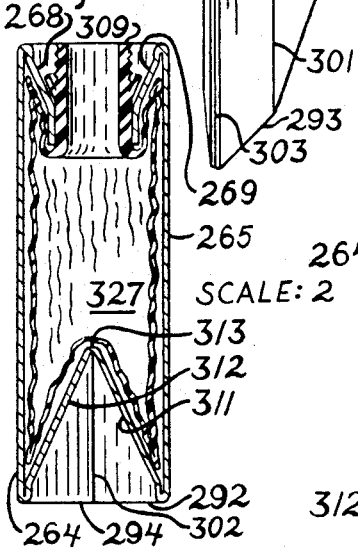
FIG. 20 is a vertical cross-section of the container for fluids in FIG. 20.
Figure 21:
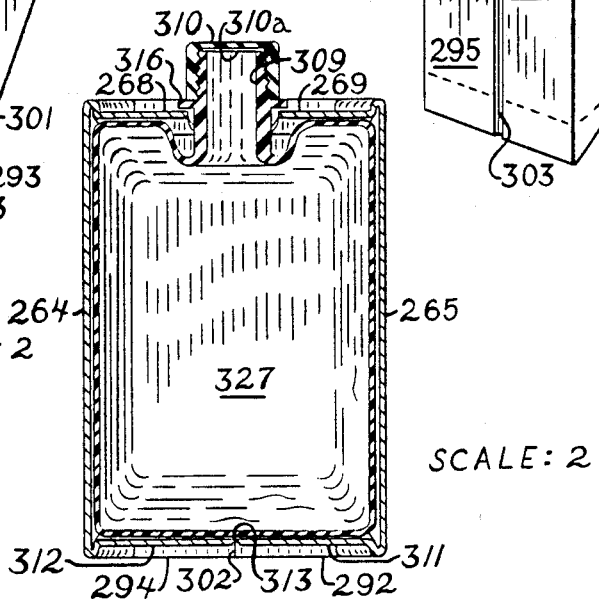
FIG. 21 is a cross-sectional view of the container for fluids in FIG. 21.
Figure 22:
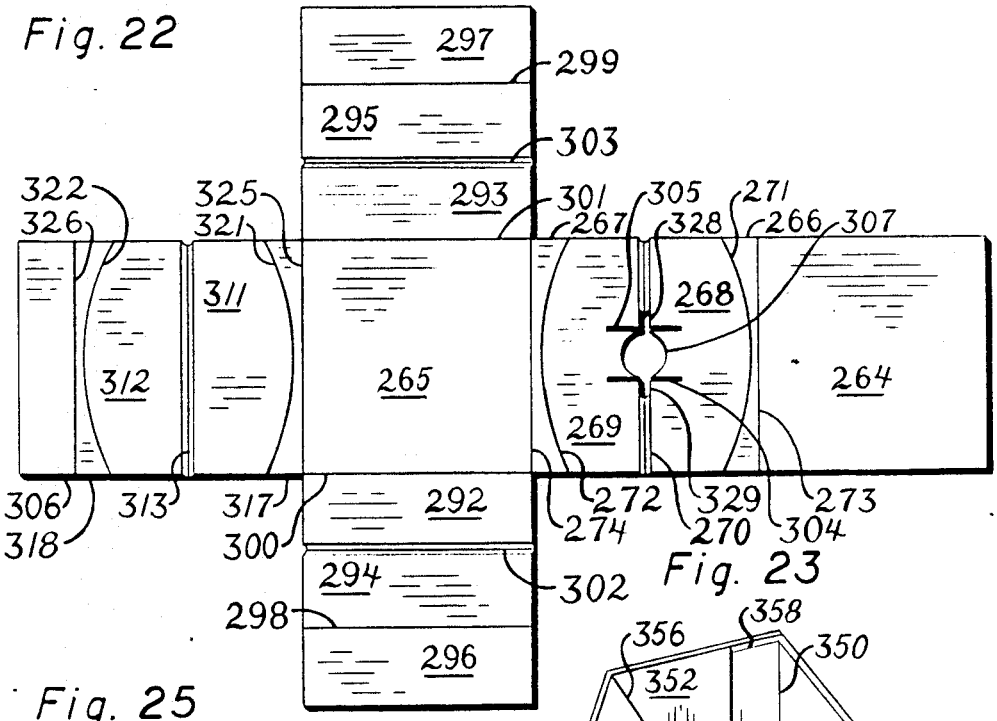
FIG. 22 is a plan view of the semirigid blank, the side which will be interior, from which the container for fluids shown in FIGS. 20 through 23 is formed.

FIG. 18, 19, 20, and 21 are views of a quickly erectable shell and bladder container, including Type 2 structural elements, suitable for materials including substantially fluid types, and FIG. 22 shows the semirigid blank from which the shell is fabricated. FIG. 18 is an isometric view of the shell and bladder container in a partially collapsed state, empty and unclosed, FIG. 19 is an isometric view of the container is an erected state, filled and closed; FIG. 20 is a cross-section of FIG. 18 and FIG. 21 is a cross section of the container in FIG. 19. Abovementioned FIG. 18 is the quickly erectable container including neck opening 309 and neck ring 316, which ring is shown in its collapsed position and a flexible, impermeable bladder 327 which is substantially surrounded by a semirigid shell including main panel 265 connected by hinge 301 to side panel 293, said side panel is connected by hinge 303 to its complementary side panel 295, which panel 295 is relatively adjacent to return panel 266, which return panel is connected by arcuate hinge 271 to arcuate stretcher panel segment 268, relatively central to which segment is located neck-opening means 309 including key 315 and neck ring 316. Relatively adjacent to said return panel 266 are coacting side panels 294 and 292 which are mutually connected by hinge 302; said panel 292 is hingedly connected to main panel 265. Arrows 20 denote the longitudinal plane of section shown in the cross sectional view, FIG. 20. FIG. 19 illustrates the erected, filled and closed container of FIG. 18 and includes front-facing main panel 265 connected by hinge 301 to side panel 293 and and which panel is connected to side panel 295 which panels are mutually connected by hinge 303; said side panel 295, which is oppositely bounded by hinge 299, is adjacent to return panel 266; said return panel 266 is connected by arcuate hinge 271 to coating arcuate stretcher panel segments 268 and 269, which stretcher panel segments are mutually connected by stretcher panel hinge 270 and which stretcher segments include notches 304 and 305 and bladder neck opening cap 310 and neck ring 316. Relatively adjacent to said return panel 266 are side panels 294 and 292 which are mutually connected by hinge 302 and which side panel 292 is hingedly connected to main panel 265. Phantom parts 272 and 321 are hidden apical stretcher panel segment 268 and 269, and basal stretcher panel segments 311 and 312, respectively.

FIG. 20 is a longitudinal cross-sectional view of the partially collapsed quickly erected container of FIG. 18 shown in twice the scale of FIGS. 18 and 19, and includes, in light-weight diagonal hatch lines, main panel 265 which is hingedly connected to coacting basal arcuate stretcher panel segments 311 and 312 which basal segments are mutually connected by hinge 313 and the latter said segment 312 is hingedly connected to main panel 164 and said panel 164 is similarly hingedly connected to coacting apical arcuate stretcher segments 268 and 269 the latter of which, segment 269, is hingedly connected to the apical portion of main panel 265; in the background, and laterally hingedly connected to said main panels, are side panels 292 and 294 which side panels are mutually connected by hinge 302. Bladder 327, indicated in cross-sectional view by heavy diagonal hatching, allows substantially fluid materials to be isolated, pressurized and interchanged between systems through means including neck opening 309.

FIG. 21 is a cross-sectional view, shown in twice the scale, of the filled, erected and closed container in FIG. 19 in which the light diagonal hatching indicates the cross section of the semirigid shell and includes main panel 265 which is connected to basal arcuate stretcher panel segment 311, which said segment and coacting basal arcuate stretcher panel segment 312 are mutually connected by hinge 313, and said panel segment 312 is hingedly connected to main panel 264, which main panel is hingedly connected to apical panel segment 268, which panel segment is hingedly connected to apical arcuate stretcher panel segment 269 and which stretcher panel segment 269 is hingedly connected to the apical portion of main panel 265. Partially in background view at bottom and top are side panels 292 and 294 which are mutually connected by hinge 302. The container includes bladder 327 which is connected to neck-opening 309, cap 310, ring 316, all of which are shown in cross section by heavy diagonal lines, and cap gasket 310*a*.

FIG. 22 provides a plan view of the semirigid blank, the face of which that will lie to the interior, from which the container shell shown in FIGS. 20, 21, 22, and 23 is fabricated, its upright axis positioned longitudinally, and includes, relatively centrally, main panel 265 which is hingedly connected relatively rightwardly to apical return panel 267 by hinge 274 and said return panel is connected to apical coacting arcuate stretcher panel segment 269 by arcuate hinge 272, said panel segment is connected to apical coacting arcuate stretcher panel segment 268 by hinge 270 and said segments include notches 304 and 305, key ways 328 and 329, and bladder neck port 307, said panel segment 268 is relatively rightwardly connected to apical return panel 266 by arcuate hinge 271 and said return panel is rightwardly connected to main panel 264 by hinge 273. Main panel 265 is relatively leftwardly connected to basal return panel 317 by hinge 325 and said return panel is connected to basal coacting arcuate stretcher panel segment 311 by arcuate hinge 321, and said segment is connected to coacting arcuate stretcher panel segment 312 by hinge 313, said stretcher panel segment 312 is connected to basal return panel 318 by arcuate hinge 322, and said return panel is connected to basal return underflap 306 by hinge 326. Said main panel 265 is relatively upwardly connected by hinge 301 to side panel 293 which, in turn, is connected to side panel 295 by hinge 303 and said panel 295 is connected to underflap 297 by hinge 299; oppositely similarly said main panel 265 is relatively downwardly connected to side panel 292 by hinge 300 which panel 292 is connected by hinge 302 to side panel 294 and said panel 294 is connected to underflap 296 by hinge 298.

Fabrication of the quickly erectable shell and bladder container is generally accomplished by, first, folding the group of panels composed of panels 306, 318, 312, 311, and 317 as a unit in a relatively rightward direction, which direction being towards the viewer and thence rightwardly towards main panel 265, on hinge 325 and then mechanically fastening or bonding adjacent portions of the face of said panel 317 and main panel 265 and, second, folding the group of panels comprised of panels 306, 318, and 312 as a unit in a relatively leftward direction on hinge 313 and, third, folding basal underflap 306 back, relatively rightward, and then mechanically fastening or bonding adjacent portions of the faces of said return panel 318 and basal underflap 306. Fourth, the group of panels comprised of panels 264, 266, 268, 269 and 267 is folded as a unit relatively leftward on the hinge 274 and then adjacent portions of the faces of said return panel 267 and main panel 265 are mechanically fastened or bonded, fifth, folding the group of panels comprised of panels 264, 266, and 268 as a unit towards the opposite, relatively rightward, direction on hinge 270. Before the final folds are made, for purposes of general description, the flexible, impermeable bag 327, including opening 309 and neck ring 316, is fabricated by processes including molding and bonding, using materials including metallized plastic film, and mated with said blank in a manner such that opening 309 and neck ring 316 are led through hole 307 and both basal and apical coacting arcuate stretcher panel segments are nested into respective adjacent flexible bladder concave folds as is roughly depicted in FIG. 20. With the flexible bladder in place, sixth, side panel 294 and underflap 296 are folded as a unit relatively upward on hinge 302 and then, seventh, side panel 295 and underflap 297 are folded as a unit relatively downward on hinge 303 and, eighth, main panel 264 is folded back, relatively leftward again, on hinge 273 and the adjacent portions of the faces of said return panel 266 and main panel 264 are mechanically fastened or bonded together. Lastly, basal underflap 306 is prepared for mechanical fastening or bonding to the underside, which is also the interior side, of main panel 264 while, concomitantly, completing steps six, seven and eight such that the basal interior faces of side panel flaps 296 and 297 are severally mechanically fastened or bonded to adjacent end portions of the upwardly facing exterior face of basal underflap 306, such that the medial portion of said underflap 306 face is mated to the basal interior face of main panel 264 and the medial and apical portions of side panel underflaps 296 and 297 are mated to the lateral portions of the interior face of main panel 264. Said return underflap 306 and said side panel underflaps are then mechanically fastened or bonded to said portions of main panel 264. It is self-evident and obvious that said flaps can be assembled in other sequences and mechanically fastened or bonded on surfaces other than those described without materially altering the container's function and include, for example, changing the position of underflap 306 such that said underflap is fastened or bonded to the exterior side of main panel 264 and said underflap is thereby exposed on the container's exterior.

Operation of the quickly erected shell and bladder container: Referring now to FIG. 2 showing a cross section of said container in a collapsed state, materials are introduced into the cavity of the bladder 327 through opening 309 such that the pressure or weight of said fluid forces the basal portion of said bladder relatively downwardly and moving downwardly also thereby the basal coacting arcuate stretcher panel segments 311 and 312, which panel segments being mutually connected by hinge 313, forcible move apart main panels 264 and 265, which said forcible moving of the main panels also move coactively upwardly apical coacting arcuate stretcher panel segments 268 and 269 in concert with the filling fluid pressure and weight to increase the fillable container volume thereby, the result of which can be seen in FIG. 21 which approximates erection by means of introducing a differential pressure which is greater in the interior region of the bladder than the region immediately external to the container. A second distinct means for erecting the shell and bladder container, referring now to FIG. 18, is the application of mechanical force, simultaneously and approximately medially, to side panel hinges 302 and 303 and indirectly to side panel pair 292 and 294, and pair 293 and 295, respectively, and decreasing the distance between said pairs of side panels and hinges, an action which thereby acts to forceably move the main panels 264 and 265 relatively apart and also moving part thereby apical and basal coacting arcuate stretcher panel segments 268 and 269 and 311 and 312, respectively, and their respective hinges. A third distinct means for erecting the shell and bladder container is to apply tension force relatively vertically divergently on the apical and basal stretcher panel hinges 270 and 313, and their adjacent coacting arcuate stretcher panel segments 268 and 269, and 311 and 312, respectively, and to forcibly move said panel segments and hinges which coact to move apart main panels 264 and 265 such that the interspace volume is thereby increased. A fourth means to erect the shell and bladder container is the application of tension force to the bladder opening 309 and oppositely to the shell and thereby moving said opening and the apical coacting arcuate stretcher panel segments 268 and 269 and included hinge relatively upward and main panels 264 and 265 relatively apart in a manner and effect similar to errecting method three above. Other means of erecting siad container are means which include combinations of the above means. While not explicitly shown in the figures, bladder 327 is considered to be joined to the shell by means including mechanical fastening and bonding which transmit movement of the shell or shell parts to said bladder or parts of said bladder such that erection movement of said shell causes similar erection movement of said bladder and a completely erected fillable container for receiving materials including fluids results from said movements.

Referring now to FIG. 18, key 315 provides means for restricting rotation of opening 309, during use including closing and unclosing by screwing and unscrewing cap 310, by said key engaging keyways 328 and 329 which can be seen in FIG. 22. Neck ring 316 of FIGS. 22 and 20 and 21 provides means for preventing opening 309 from inadvertently withdrawing into the interior of the erected shell through hole 307 during conditions including that of bladder 327 being partially full. Notches 304 and 305, seen in FIGS. 19 and 22, in the shell provide means to accomodate bladder opening 309 including during the condition in which the container is collapsed.

Figure 23:
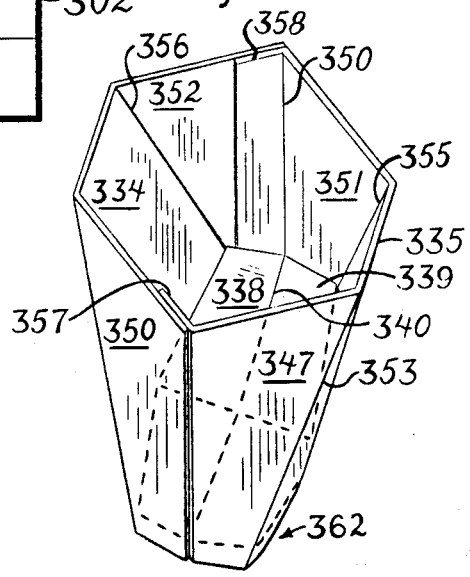
FIG. 23 is an isometric view of a quickly erected, semirigid plan-symmetric, open-top container.
Figure 25:
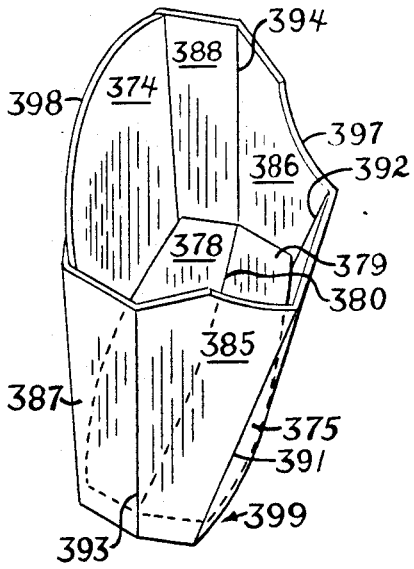
FIG. 25 is an isometric view of a quickly erected, semirigid scoop-front container.
Figure 24:
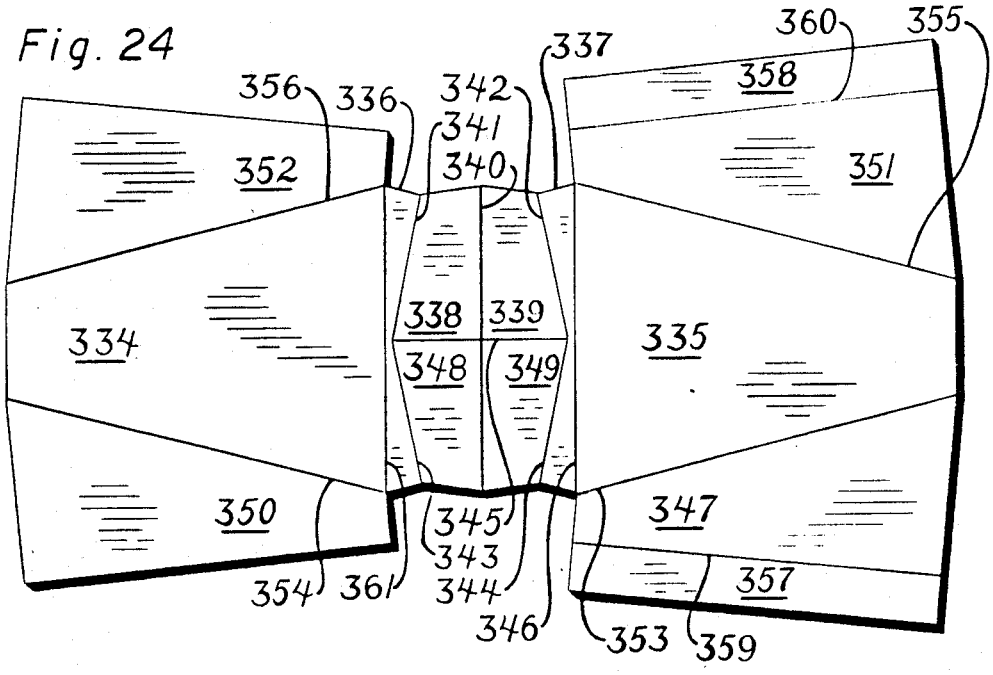
FIG. 24 is a plan view of the semirigid blank, the side which will be interior, from which the container in FIG. 25 is fabricated.
Figure 26:
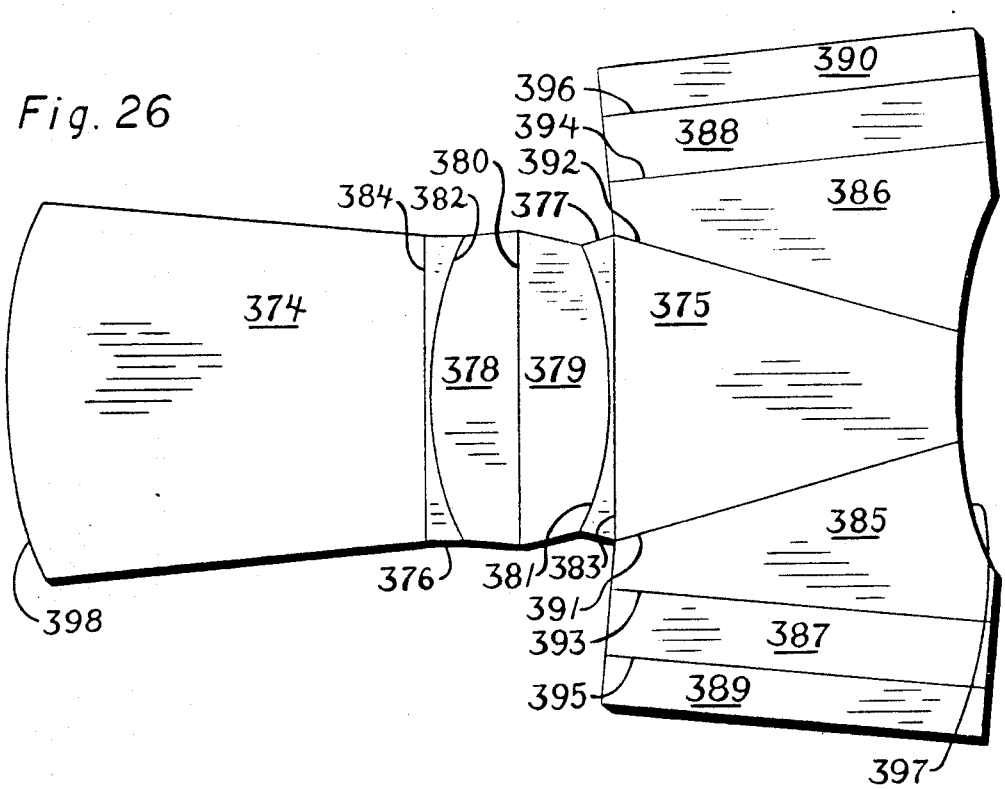
FIG. 26 is a plan view of the semirigid blank, the side which will be interior, from which the container in FIG. 27 is formed.

FIGS. 23 and 25 are isometric views of an open-top, plan-symmetrical container embodying Type 1 quickly erectable structural elements and an open-top, plan-asymmetrical container embodying Type 2 quickly erectable structure, respectively, and FIGS. 24 and 26 severally are plan views of the semirigid blanks from which the containers of FIGS. 25 and 27 are fabricated.

FIG. 23 is a quickly erectable container including main panel 334 which, proceeding in a clockwise direction, is connected to side panel 352 by hinge 356 and the interior face of said side panel is adjacent to side panel underflap 358 which is connected to side panel 351 by hinge 350 and said panel 351 is connected to main panel 335 by hinge 355 and said panel 335 is connected to side panel 347 by hinge 353 and said side panel is connected to side panel underflap 357 by hinge 359 and said underflap 357 is mechanically fastened or bonded to the face of side panel 350 and said side panel is connected to main panel 334 by hinge 354 and said main panel is adjacent to the container bottom including quarter panel segments 338 and 339 which are mutually hingedly connected.

FIG. 24 is a plan view of the semirigid blank from which the container in FIG. 23 is fabricated and in which on the lefthand side can be seen main panel 334 which is connected relatively downwardly and upwardly to trapezoidal side panels 350 and 352 by hinges 354 and 356, respectively, and said main panel is connected relatively rightwardly to return panel 336 by hinge 361 and the righthand side of said return panel is connected relatively upwardly and downwardly to basal coacting quarter panel segments 338 and 348 by intersecting hinges 341 and 343, respectively, and said laterally adjacent panel segments are connected severally to segments 339 and 349 by common hinge 340 and pairs of tandemly adjacent basal quarter panel segments, segments 338 and 339, and segments 348 and 349, are severally downwardly and upwardly mutually connected by common hinge 345 and said panel segments 339 and 349 are connected to return panel 337 by intersecting hinges 342 and 344, respectively, and said return panel is connected to main panel 335 by hinge 346 and said main panel is connected relatively downwardly and upwardly to trapezoidal side panels 347 and 351 by hinges 353 and 355, respectively, and said side panel 347 is relatively downwardly connected to side panel underflap 357 by hinge 359 and said side panel 351 is relatively upwardly connected to side panel underflap 358 by hinge 360.

Fabrication of the plan-symmetric, open-top container of fig. 23 having Type 1 structural elements: Referring now to FIG. 24, the group of contiguous panels 335, 347, 351, 357, and 358, taken as a unit, are folded in a direction which is relatively leftward over panel 334, et alii, on hinge 346 and the interior face, the side facing the viewer, of return panel 337 is mechanically fastened or bonded to the basal adjacent portion of the interior face of main panel 335. Second, the group of contiguous panels 335, 337, 339, 349, 347, 351, 357, 358 are folded in a reverse direction, relatively rightwardly, on hinge 340. Third, the group of contiguous panels 334, 350, and 352, taken as a unit, are folded in a relatively rightwardly direction on hinge 361 and return panel 336 is mechanically fastened or bonded to the adjacent basal portion of main panel 334. And, fourth, side panel underflaps 357 and 358 are severally folded relatively upwardly and downwardly on hinges 359 and 360 and the undersides of said underflaps are mechanically fastened or bonded to the adjacent portion of the interior face of side panels 350 and 352, respectively. Alternatively, the container in FIG. 23 can be fabricated by molding methods.

Operation of the quickly erected plan-symmetric, open-top container having Type 1 structural elements: Erection of said container from the collapsed state is accomplished by applying force simultaneously inwardly and substantially medially to hinges 359 and 360 which causes said hinges and adjacent side panels to converge, concomitantly, causing in turn the diverging movement of main panels 334 and 335 and said movement is severally transmitted to coacting paired stretcher quarter panel segments 338 and 348 and similarly paired segments 339 and 349 by intermediating return panels 336 and 337, respectively. Said quarter panel segments 338 and 348 are contraposed severally relatively adjacently over coacting stretcher quarter panel segments 339 and 349, all of whcih panel segments are mutually articulated by hinge 340 and oppositely therefrom articulated severally by hinges 341, 342, 343, and 344 to said return panels, move mutually oppositely in conjunction with the mutually opposing movement of main panels 334 and 335 such that a point of configurational instability is coactively attained by said quarter panel segments due to the relative linear divergence of hinges 341 and 342 and that of hinges 343 and 344 at which instability point the panel portion adjacent to hinge 345 moves sharpley, "snaps," downward, relative to the upright container of FIG. 23, to a second stable configuration in which the container bottom means, medially to the container, is dihedrally formed of a pair of sloping, downwardly intersecting planes having as lowest extent hinge 345 and mutually oppositely disposed points forming a dihedral angle therewith. The container so formed features, in elevation, a linear base formed of a periphery of rails 362 including paired return panel rails. Such an open-top container has uses including that of a collapsible container for comestibles.

FIG. 25 is an isometric view of quickly erectable, plan asymmetric, open-top container including Type 2 structural elements and includes, clockwise, main panel 375 which is hingedly connected to substantially trapezoidal side panel 385 by hinge 391 and said side panel is connected to side panel 387 by hinge 393 and said panel 387 is hingedly connected to side panel overflap 389, the interior face of which overlap is adjacent to scoop main panel 374, and said scoop panel 374 is laterally oppositely adjacent to side panel overflap 390 which is hingedly connected to side panel 388 by hinge 396 and said side panel 388 is connected to substantially trapezoidal side panel 386 by hinge 394 and said trapezoidal side panel is connected to main panel 375 by hinge 392. Basally interiorly are coacting arcuate stretcher panel segments 378 and 379 which are mutually connected by stretcher panel hinge 380 and basally exteriorly are located the base rails 399; apically rightwardly is concave free edge 397 and relatively contraposedly is convex scoop free edge 398.

FIG. 26 is a plan view of the blank, the side which will be interior, from which the container is FIG. 25 is fabricated and includes main scoop panel 374, the distal free edge, relatively leftward, of which is substantially convexedly curved to form a scoop 398, said main panel is rightwardly connected to return panel 376 by hinge 384 and said return panel is connected to arcuate stretcher panel segment 378 by arcuate hinge 382 and said segment 378 is connected to coacting arcuate stretcher panel segment 379 by stretcher panel hinge 380 and said segment 379 is connected to return panel 377 by arcuate hinge 381 and said return panel is connected to main panel 375 by hinge 383 and said main panel is relatively downwardly connected to substantially trapezoidal side panel 385 by hinge 391 and said trapezoidal panel is connected to side panel 387 by hinge 393 and said side panel is connected to side panel overflap 389 by hinge 395. Said main panel 375 is relatively upwardly connected to substantially trapezoidal side panel 386 by hinge 392 and said trapezoidal panel is connected to side panel 388 by hinge 394 and said side panel is connected to side panel overflap 390 by hinge 396 and the rightwardly free edge of said main panel 375 and the adjacent portions of the free edges of trapezoidal side panels 385 and 386 are mutually formed as concavity 397 in complementary relation to said leftward convex free edge, scoop 398, such that the next, rightwardly adjacent blank which is concomitantly and contiguously formed from the base, substantially continuous, flat stock is produced with minimal waste of said stock.

Fabrication of the quickly erectable, plan-asymmetric, open-top container in FIG. 25 froom the blank shown in FIG. 26: first, the group of panels consisting of panels 374, 376, 378, 379, and 377, are folded as a unit in a direction relatively rightwardly on hinge 383 and the interior face, meaning the face presented to the viewer in FIG. 26, of return panel 377 is mechanically fastened or bonded to the adjacent portion of the face of main panel 375. Second, the group of panels, consisting of panels 374, 376, and 378, is folded in a relatively leftward direction on hinge 380. Third, the panel 374 is folded in a direction relatively rightward on hinge 384 and the interior face of return panel 376 is mechanically fastened or bonded to the adjacent portion of the face of main scoop panel 374. Fourth, side panel overflap 390 and side panel 388, are folded as a unit in a relatively downward direction on the hinge 394 and the face of said overflap 390 is mechanically fastened or bonded to the exterior face of main panel scoop 374. Oppositely similarly, side panel overflap 389 and side panel 387, are folded as a unit in a relatively upward direction on the hinge 393 and the face of said overflap 389 is mechanically fastened or bonded to the adjacent exterior face of said main panel scoop 374.

Operation of the quickly erectable, plan-asymmetric, open-top container: Referring now to FIG. 25, the fabricated container in its erected state, which is the second state of two gemoetrically stable configurations, the first state of said container configurational is the collapsed state in which said container is transported and stored prior to use and said container is erected by applying compression force, including that applied by a person's hand which causes movement of the affected panels in a manner similar to that used in erecting the container of fig. 23, simultaneously on both lateral extremities approximately medially to the hinges 393 and 394. Said force then causes the movement of main panels 374 and 375 mutually apart and said movement is concomitantly transmitted to bottom coacting arcuate stretcher panel segments 378 and 379 by intermediating return panels 376 and 377, respectively. Said stretcher panel segments 378 and 379 are mutually articulated by stretcher panel hinge 380 and severally along margins disposed oppositely therefrom by arcuate hinges 381 and 382 by which said segments move mutually oppositely in conjunction with the mutually opposing movement of main panels 334 and 335 such that a point of maximal configuration instability is reached by said stretcher panel segments due to the relative geometric divergence from substantial contraposition of said segments due to the shape, the divergence and subsequent convergence, of arcuate hinges 381 and 382, at which instability point the bottom portion medially adjacent to hinge 380 snaps downward, relative to the upright container of FIG. 25, to the second stable geometric configuration in which the interiorly concave container bottom is formed of a continuously curved surface having as its lowest extent the medial portions of said stretcher panel segments 378 and 379, which portions coincide with their broadest width, along the common minor axis of said panel segments in FIG. 25. The container so formed features a substantially linear bottom surface 399 composed of paired return panel rails and side panel basal portions, the prior of which are formed during fabrication by the folding operation performed on straight linear hinges 383 and 384. Such an asymmetric, open-top container has uses including that of a bulk food portioning container and scoop.

While the above description contains many specifications, these descriptions should not be construed as limitations on the scope of the invention but merely as exemplifications of the preferred embodiments thereof. Those persons skilled in the art will envision many other possible variations within its scope. For example, skilled artisans will be readily able to change the dimensions and shapes of the various embodiments. They will also be able to fabricate the containers in materials such as plastics and paper. Also, they can mold all or parts of the containers using the aformentioned examples of materials. Further, skilled artisans will be readily able to add colors, textures, and graphic designs to these containers. For example, the base of the enclosed-type structure can be fabricated in red plastic and the roof in black plastic to produce a structure which looks like a small barn. Additionally, the stretcher panels of one end of an enclosed-type structure can be made to operate inwardly upon erection, making the concave end profile coincide with the convex side profile of a second structure, and the perpendicular union of the two thus produces a tee-plan structure. Accordingly, the reader is requested to determine the scope of the invention by the appended claims and their legal equivalents, and not by the examples which have been given.

I claim:

1. A container erectable from a collapsed state, comprising:

a. a pair of upright,contraposed, substantially rigid panels, b. a substantially rigid, articulated, nonrectangular panel bottom means mesially connected to said upright panels by hinge means, the major axes of which hinge means are not single, continuous, straight lines, and which panel bottom means, when moved by an operation to erect said container, operates in a bistably deformable manner relatively outwardly from the interior of said container to deformably separate said pair of upright panels and thereby form an interspace therebetween, and c. a pair of substantially flexible side panel means which substantially connect contraposed lateral edges of said pair of upright panels.

2. The container of claim 1 which includes means for transmitting said container erecting movement from a source, including a person, substantially medially normally to said panel bottom means.

3. The container of claim 2 including a packet means which includes substances which modify the container and its contents or the odor of said container and contents and which packet means substantially discharges said substances upon erection of said container.

4. The container of claim 2 which includes at least one envelope.

5. The container of claim 2 in which the apical edges of said upright panels are hingedly connected to outwardly swingable panels which provide means including for grasping said container and introducing materials from their source into said container in a scooping or sweeping manner.

6. The container of claim 2 in which said side panel means are a pair of substantially rigid, longitudinally articulated side panels each of which is laterally hingedly connected to adjacent contraposed lateral edges of said pair of upright panels.

7. The container of claim 6 in which the apical edges of said upright panels are hingedly connected to outwardly swingable panels which are laterally hingedly attached by substantially bendable gussets to each of said apical edge of adjacent said side panels and which provide means including for grasping said container and introducing materials into said container from their source in a scooping or sweeping manner.

8. The container of claim 6 in which at least one lateral hinge of at least one of said panels substantially diverges relative to the container longitudinal axis such that at least one of said panels is substantially trapezoidal in shape.

9. The container of claim 8 in which the free, apical edge of one of said upright panels is convexly shaped to provide a scoop to aid in introducing materials including food portions into said container and the free, apical edge of the opposite upright panel is concavely shaped in a manner complementary to said convexly shaped edge.

10. The container of claim 6 in which the interior faces of said side panels include support means to maintain the relative position of the free lateral edges of said panel bottom means when containing heavy materials.

11. The container of claim 10 in which the means include one or more interdigitated lugs each of which is paired with a lug receptacle located oppositely, in the collapsed container, in said interior face of the adjacent, substantially contraposed panel of each contiguous pair of side panels.

12. The container of claim 2 comprising, a. a second, relatively upper, articulated, outwardly moving, bistably deformable panel, disposed oppositely in the container from said bottom panel means, such that a container which is substantially closed on all sides results and, b. at least one substantially flexible bladder for isolating, pressurizing, and interchanging substantially fluid materials in and between systems including said container, fluid filling, and organisms, and including at least one opening with closure and means for securing said opening in relation to said panels in the course of said materials being interchanged between said systems, and access for said opening through said panels.

13. The container of claim 12 in which said ride panel means is a pair of substantially rigid, articulated panels each of which is oppositely laterally hingedly connected to adjacent contraposed lateral edges of said upright panels.

14. A collapsible container comprising, a. a pair of similar, upright, contraposed, substantially rigid and deformable, main panels, b. a pair of substantially upright, rigid, articulated, substantially apically bistably deformable panels which are mesially laterally disposed to said pair of main panels, each of which said bistably deformable panels is hingedly connected to adjacent contraposed lateral edges of said pair of main panels and, when movably deformed by means to transmit a deforming force from a source, including a person, substantially medially apically to said deformable panel, extends normal to and separates adjacent portions of said pair of main panels to form interspace therebetween and, c. a tension top means which substantially connects contraposed apically adjacent edges of said pair of main panels and substantialy constrains said separation of said pair of main panels to the extent of movement of said bistably deformable panels and, d. a bottom means, substantially planar and horizontal, extending basally between panels to form a lower boundary of said interspace and support objects located therein.

15. The container of claim 14 in which said bistably deformable panels operate, during erection of said container, in a direction relatively outwardly from said interspace.

16. The container of claim 14 in which at least one of said top and bottom means is fabricated of substantially flat, semirigid material, longitudinally articulated and hingedly connected to said upright panels.

17. A flat, substantially elongate, integral blank comprising, a. medially to the blank, a pair of mutually hingedly connected panel segments bounded oppositely distally by a pair of substantially transverse hinges, at least a portion of said pair of hinges divertes medially from a straight axis, b. a pair of return panels distally oppositely disposed to said hinges and proximally connected to said hinges, the proximal edges of which are shaped complementarily to the shapes of said hinges, and the distal edges of which are substantially transverse, c. a pair of substantially rectangular main panels distally oppositely disposed to said return panels, each of whcih is proximally hingedly connected to each of said return panels.

18. The integral blank of claim 17 in which at least one additional panel is distally hingedly connected to at least one of said main panels.

19. The integral blank of claim 18 in which additional panels are laterally hingedly connected to at least one of said main panels.

20. The integral blank of claim 19 in which an additional pair of mutually transversely hingedly connected panel segments bounded oppositely distally by a pair of substantially transverse hinged, at least a portion of said pair of hinges substantially diverges medially, which are oppositely distally hingedly connected to a pair of proximally complementarily shaped return panels, one of which return panels is distally transversely hingedly connected to a panel joining flap and the oppositely disposed said return panel is distally hingedly connected to the distal edge of one of said main panels.

* * * * *